United States Patent [19]

Young

[11] 3,948,300

[45] Apr. 6, 1976

[54] DEBARKING APPARATUS INCLUDING LOG VELOCITY CONTROLLING MEANS

[75] Inventor: Douglas L. G. Young, Lennoxville, Canada

[73] Assignee: Canadian Ingersoll-Rand Company Ltd., Montreal, Canada

[22] Filed: Oct. 25, 1974

[21] Appl. No.: 517,894

[52] U.S. Cl. ..... 144/208 B

[51] Int. Cl.[2] ..... B27L 1/04

[58] Field of Search ..... 144/208 B, 311

[56] References Cited

UNITED STATES PATENTS

| | | | |
|---|---|---|---|
| 788,675 | 5/1905 | Rissmuller | 144/208 B |
| 3,158,255 | 11/1964 | Schnyder | 144/208 B X |
| 3,286,747 | 11/1966 | Delcellier | 144/208 B |
| 3,746,063 | 7/1973 | Smiltneek | 144/208 B |
| 3,807,469 | 4/1974 | Schnyder | 144/208 B |

*Primary Examiner*—Al Lawrence Smith
*Assistant Examiner*—Gary L. Smith
*Attorney, Agent, or Firm*—Bernard J. Murphy

[57] ABSTRACT

Log debarking apparatus comprising a rotatable drum and a downwardly sloping feed chute for feeding logs into the inlet end of the drum. The drum is provided with anvil means located to prevent logs from being carried circumferentially around the drum by its rotation and carries debarking tools adapted to apply hammer-like impact blows to logs in the drum, the anvil means controlling the velocity circumferentially of the drum at which logs are supplied to such debarking tools. Adjacent to its inlet end, the drum carries a plurality of arcuately spaced apart vanes, each extending for only a minor portion of the length of the drum, which serve to control the velocity of logs supplied into the drum and cooperate with the anvil means to provide proper orientation of such supplied logs.

7 Claims, 4 Drawing Figures

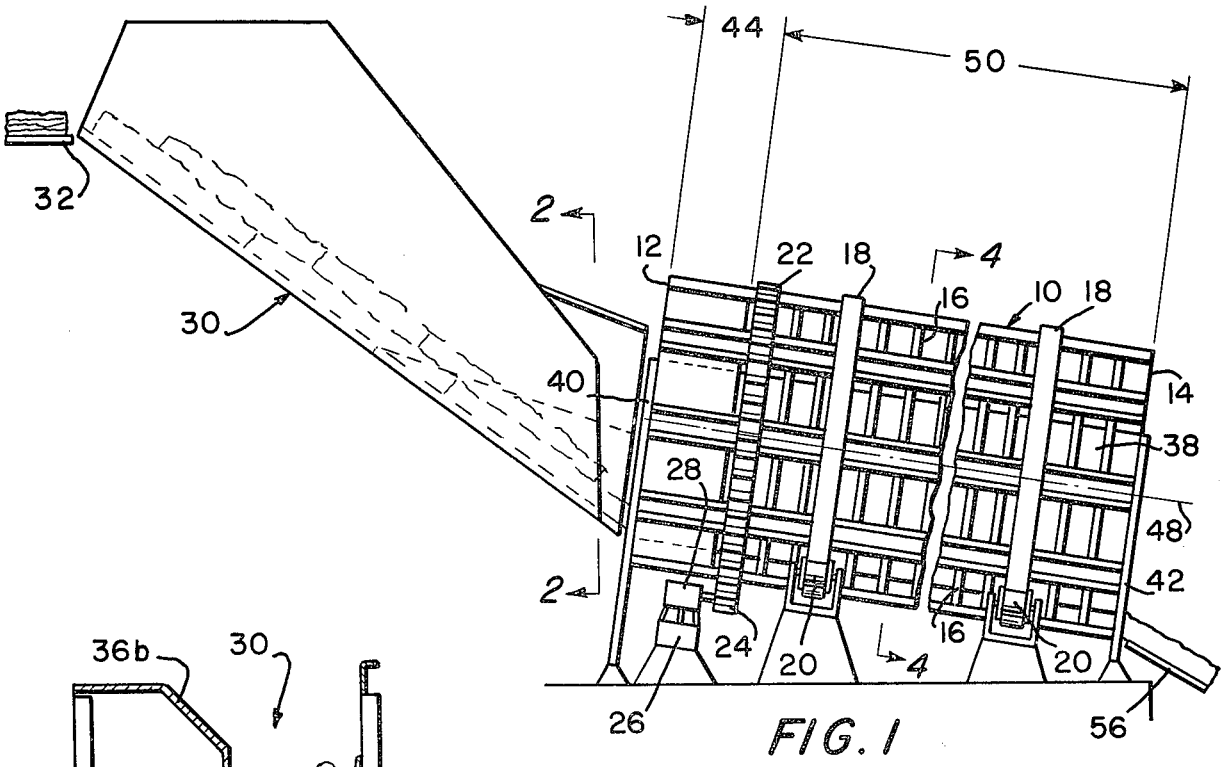
FIG. 1
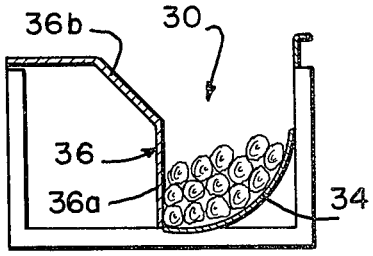
FIG. 2
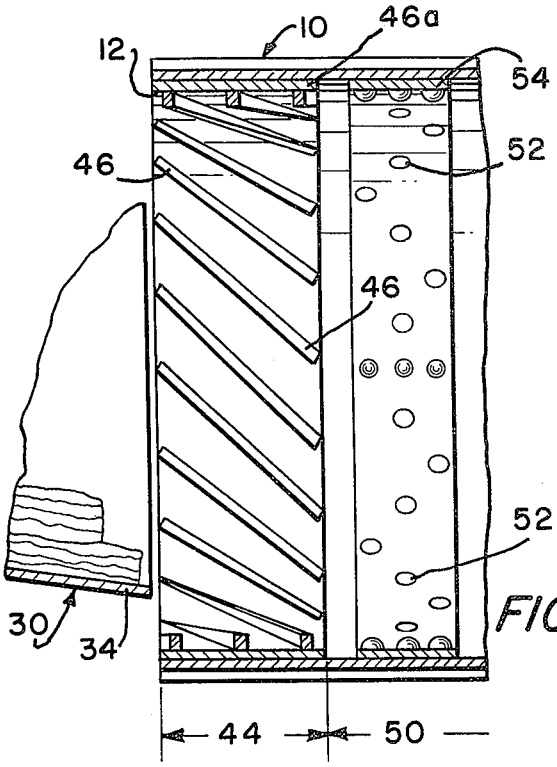
FIG. 3
FIG. 4
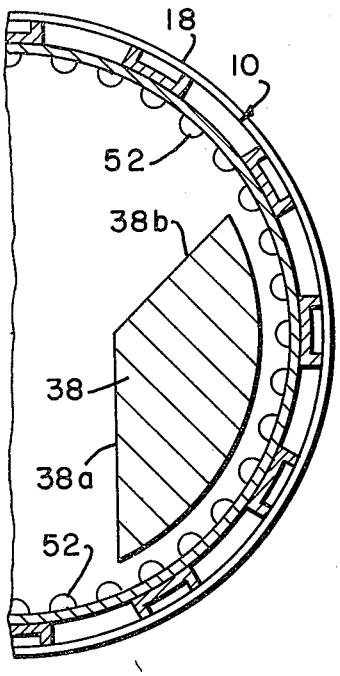

DEBARKING APPARATUS INCLUDING LOG VELOCITY CONTROLLING MEANS

The present invention relates to debarking apparatus and more particularly to the control of logs fed into rotatable drum-type debarking apparatus.

An object of the present invention is to provide new and improved rotatable drum-type barking apparatus including means particularly adapted for controlling the velocity of logs fed into the drum means of such apparatus.

Another object of the invention is to provide new and improved debarking apparatus of the type set forth including means particularly adapted to, upon supply of single logs into the drum means, reduce the velocity of such single logs longitudinally of the drum means.

Another object is to provide new and improved debarking apparatus of the type set forth including means particularly adapted to, upon supply of a large group of logs into the drum means, increase the velocity of logs of such group longitudinally of the drum means.

Another object is to provide new and improved debarking apparatus of the type set forth including means particularly adapted for orientation of the logs supplied into the drum means whereby undesirable misalignment of such logs is readily corrected.

Other objects and advantages of the invention will become apparent from the following description taken in connection with the accompanying drawings wherein, as will be understood, the prefered embodiment of the invention has been given by way of illustration only.

In accordance with the present invention, debarking apparatus may comprise rotatable debarking drum means including an inlet end for receiving logs to be debarked and a discharge end for discharging logs, anvil means inside of the drum means at a location to prevent logs therein from being carried circumferentially around the drum means by the rotation of the drum means, means carried by the drum means within the drum means adjacent the inlet end thereof controlling the velocity of logs supplied into the drum means through its inlet end, and debarking tool means carried by the drum means within the drum means intermediate the log velocity controlling means and the discharge end of the drum means for debarking logs in the drum means.

Referring to the drawings:

FIG. 1 is an elevational side view illustrating debarking apparatus representing one embodiment of the invention;

FIG. 2 is an elevational sectional view taken on Line 2—2 of FIG. 1, looking in the direction of the arrows;

FIG. 3 is a substantially enlarged elevational sectional view of the inlet end of the drum means of the debarking apparatus of FIGS. 1 and 2; and FIG. 4 is an enlarged partial elevational sectional view taken on Line 4—4 of FIG. 1, looking in the direction of the arrows.

Referring more particularly to the drawings wherein similar reference characters designate corresponding parts throughout the several views, the illustrated debarking apparatus comprises an annular, elongated drum or drum means, designated generally as 10, having an open inlet end 12 adapted to receive the logs to be debarked and an open discharge end 14 adapted to discharge the debarked logs. The drum 10 may include the usual bark discharge openings 16 and is angled downwardly from its inlet end 12 towards its discharge end 14 to facilitate the passage of logs longitudinally therethrough. The drum 10 includes a pair of annular circumferential tires 18 at spaced locations along its length and is rotatably mounted in the described downwardly angled disposition by pairs of rotatable trunion rollers 20 rotatably engaging each of the tires 18, it being understood that only one of each pair of the rollers 20 has been shown in FIG. 1. The drum 10 rigidly carries an annular, circumferential, toothed gear 22 intermeshing with a driving pinion 24 and is rotatably driven in the clockwise direction, as viewed in FIG. 4, by a conventional, variable speed driving motor 26 which is drivingly connected to the pinion 24 through a conventional speed reducer 28. As will be understood, however, such illustrated drum mounting and pinion driving arrangements have been shown only for the purposes of illustration; and the drum 10 may be otherwise suitably rotatably mounted and driven.

A downwardly sloping, log feed chute 30 is provided adjacent the inlet end 12 of the drum 10 for longitudinally feeding logs into the drum 10 through such inlet end 12, the log feed chute 30 being operatively associated with a conventional log feed conveyor 32 to receive the logs from a wood pile (not shown). As illustrated in FIG. 2, the log feed chute 30 includes an arcuate bottom wall 34 which upwardly extends to define one side of the chute 30; and the other or opposite side of the chute 30 is defined by a wall 36 which has a vertical lower portion **36*a* and an angled upper portion 36*b*. A conventional discharge conveyor 56 is positioned adjacent the discharge end 14 of the drum 10** for conveying the debarked logs from the debarking apparatus.

The debarking apparatus further comprises an elongated anvil or log deflector 38 which longitudinally extends completely through the drum 10 and at its opposite ends is rigidly supported by ground mounted supporting frames 40, 42. The anvil is positioned within the downturning side of the drum 10 aligned with the chute wall 36 and at a location to prevent rimming of logs with the drum 10 during the drum driven rotation (that is, to restrict log movement with the drum 10 during its rotation by preventing logs from being carried completely around the inner circumference of the drum 10 by such rotation). The anvil 38 includes a vertical anvil face **38*a* aligned with the chute wall portion 36*a* and an angled anvil face 38*b* aligned with the chute wall portion 36*b*, the anvil faces 38*a*, 38*b* being of length such as to cause the cross-sectional open area within the drum 10 to correspond to the cross-sectional open area of the chute 30 adjacent the lower end thereof. As illustrated, the anvil 38 is fixedly mounted to be retained in fixed position throughout the operation of the debarking apparatus. Alternatively, however, as will be understood, the anvil 38 could be pivotally mounted on the supports 40, 42 either for adjustment or swinging movement during the operation of the apparatus providing that the drum 10 is rotatable relative to the anvil 38. Also, as will be understood, the illustrated configuration of the anvil 38 has shown for the purposes of illustration only; and the anvil 38** could be of other suitable construction.

For a minor portion 44 of its length adjacent to the inlet end 12, the drum 10 carries means particularly adapted for controlling the velocity, longitudinally of the drum 10, of the logs longitudinally supplied into the inlet end 12 by the log feed chute 30, such means being also cooperative with the anvil 38 for controlling the orientation of such supplied logs within the drum 10 adjacent the inlet end 12. More particularly, as illustrated, adjacent to the inlet end 12, the drum inner circumference rigidly carries a plurality of upstanding vanes or flights 46 which are arranged at spaced locations around such inner circumference and disposed to longitudinally extend arcuately at an angle relative to the downwardly sloping centerline 48 of the drum 10. The vanes 46 are shown as each formed from plates contoured in the configuration of a short segment of a spiral around such drum centerline 48 and each are of a length to extend, longitudinally of the drum 10, for only the beforementioned minor portion 44 of the length of the latter. Although the vanes 46 are shown as all being affixed to an annular mounting plate 46*a* mounted on the drum inner circumference, it will be understood that the vanes 46 could be otherwise suitably mounted to the drum 10. It will also be understood that, although the vanes 46 are shown as being of arcuate configuration, they could alternatively be formed of straight construction angled relative to the centerline 48.

Throughout the portion 50 of the drum length intermediate the vanes 46 and the drum discharge end 14 (that is, throughout the major portion of the length of the drum 10), the drum inner circumference carries debarking tools 52 particularly adapted for applying high unit pressure, localized impact blows to logs in the drum 10 during the rotation of the latter. As illustrated, the debarking tools 52 are in the form of relatively blunt protrusions arcuately contoured on all working sides to prevent log damage and arranged in sets mounted on the drum 10 by annular mounting rings 54, it being understood, however, that the tools 52 could be of other configuration suitable to provide such impact blows without log damage and/or otherwise suitably mounted and arranged on the drum 10. The anvil 38, as shown in FIG. 4, at its lower end is constructed to cause logs in the drum 10 to be supplied to the tools 52 with a minimal velocity circumferentially of the drum, thus maximizing the impact forces between the tools 52 and the logs mass in the drum 10.

Throughout the operation of the debarking apparatus, the drum 10 is continuously rotatably driven by the driving motor 26 in the clockwise direction indicated by the arrow in FIG. 4. The log feed conveyor 32 is continuously driven (for example, at a velocity between 100 and 300 feet per minute) to longitudinally supply logs (for example, each weighing between 100 and 2000 pounds and being of length about the inside drum diameter) to the log feed chute 30 which, in turn, longitudinally feeds the logs into the inlet end 12 of the drum 10. The longitudinal velocity at which the logs are thus received in the inlet end 12 is high (for example, up to 300 feet per minute) in the event that only single logs or a relatively small group of logs is supplied, but very low as concerns trailing logs of a supplied large group of logs. In either event, however, the longitudinal velocity of the logs is changed (that is, increased or decreased) to a velocity closer to, but greater than, the longitudinal velocity desired in the section 50 of the drum 10 which may be, for example, in the range of 6 to 30 feet per minute, while gross angular mis-alignment or mis-orientation of the logs is prevented during this change in longitudinal velocity to prevent the possible plugging of the drum 10 or tumbling of the logs therein which might otherwise occur.

More particularly, in the event that a single log or small group of logs is thus supplied into the inlet end 12, the leading ends of the supplied logs interact with the angled vanes 46 whereby such vanes 46 substantially decelerate the log velocity, the angle of the vanes employed in any embodiment serving to control the rate of such deceleration. The vanes 46, moreover, cooperate with the anvil 30 to maintain the logs properly oriented at least generally in alignment longitudinally of the drum 10. In the event that a large group of logs is supplied into the inlet end 12, the leading logs of the group will be decelerated as above described in the case of single logs, thereby reducing the longitudinal velocity of the trailing logs of the group to a value possibly lower than that desired in the drum portion 50. As such trailing logs of the group are moved into the inlet end 12, however, the vanes 46 act to substantially accelerate such logs from their lower velocity while axially moving the logs longitudinally into the drum 10 to prevent any possible plugging of the log feed chute 32. Again, the vanes 46 maintain the logs properly oriented at least generally in alignment longitudinally of the drum 10.

The logs are discharged into the drum portion 50 at a velocity higher than the longitudinal velocity maintained in the drum portion 50, thereby minimizing the volume of logs maintained in the drum portion 44 relative to the volume of logs maintained in the upstream end of the drum portion 50. Orientation of the logs discharged from the drum portion 44 to the drum portion 50 is, moreover, automatically controlled by the vanes 46, thereby avoiding the possibility of possible plugging of the drum 10 by mis-orientation of such discharged logs.

From the preceding description it will be seen that the invention provides new and improved means for attaining all of the beforedescribed objects and advantages. It will be understood, however, that, only a single embodiment of the invention has been illustrated and hereinbefore specifically described, the invention is not limited merely to this single embodiment but rather contemplates other embodiments and variations within the scope of the following claims. It will be further understood that, although the beforedescribed debarking apparatus includes only a single drum 10, alternatively additional drums could be provided intermediate the discharge end 14 of the described drum 10 and the discharge conveyor 38. In this event, such additional drums would not, of course, be provided with the described vanes 46, but rather would merely be provided with the debarking tools 52 or other suitable debarking tools, and the discharge end 14 of the described drum 10 would merely discharge the logs from the section of the debarking apparatus formed by the drum 10 to the next drum or section of the apparatus. Moreover, the vanes 46 could be constructed of substantially spiral configuration but with varying angle of spiral along their lengths, thereby facilitating their control of the log deceleration rate.

Having thus described my invention, I claim:

1. Debarking apparatus comprising rotatable debarking drum means including an inlet end for receiving logs to be debarked and a discharge end for discharging logs, log feed chute means downwardly sloping towards said inlet end of said drum means for feeding logs into said inlet end, anvil means extending longitudinally through said drum means and at a location to prevent logs within said drum means from being carried circumferentially around said drum means by rotation of said drum means, means carried by said drum means within said drum means adjacent said inlet end thereof controlling the velocity of logs supplied into said inlet end of said drum means by said log feed chute means, said log velocity controlling means comprising a plurality of vanes angled relative to the centerline of said drum means and longitudinally extending only a minor portion of the length of said drum means, and debarking tool means carried by said drum means within said drum means intermediate said angled vanes and said discharge end of said drum means for debarking logs in said drum means, said debarking tool means comprising means adapted for applying high unit pressure, impact blows to logs in said drum means during the rotation thereof.

2. Debarking apparatus according to claim 1, wherein said angled vanes are operable, upon supply of single logs into said inlet end, for reducing the velocity of such single logs longitudinally of said drum means.

3. Debarking apparatus according to claim 2, wherein said angled vanes are operable, upon supply of a group of logs into said inlet end, for increasing the velocity of logs of such group longitudinally of said drum means.

4. Debarking apparatus according to claim 2, wherein said vanes are cooperative with said anvil means for controlling the orientation of logs.

5. Debarking apparatus according to claim 1, wherein said debarking tool means comprises a plurality of protrusions arcuately contoured on all working sides.

6. Debarking apparatus according to claim 1, wherein said anvil means includes anvil face means aligned with wall means defining said log feed chute means.

7. Debarking apparatus according to claim 1, wherein said angled vanes are provided with varying angle of spiral along their lengths.

* * * * *